US007826760B2

(12) United States Patent
Willis

(10) Patent No.: US 7,826,760 B2
(45) Date of Patent: Nov. 2, 2010

(54) DOCUMENT PROCESSING SYSTEM WITH CONFIGURABLE GRAPHIC DISPLAY OF PRINT CONSUMABLE LEVEL

(75) Inventor: Keith Lamar Willis, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 239 days.

(21) Appl. No.: 12/016,509

(22) Filed: Jan. 18, 2008

(65) Prior Publication Data

US 2009/0185814 A1 Jul. 23, 2009

(51) Int. Cl.
*G03G 15/00* (2006.01)
*G03G 15/01* (2006.01)

(52) U.S. Cl. ..... 399/81; 399/8; 399/24; 399/28

(58) Field of Classification Search ..... 399/8, 399/9, 24, 27, 28, 81, 223, 262
See application file for complete search history.

(56) References Cited

U.S. PATENT DOCUMENTS

| | | | | |
|---|---|---|---|---|
| 5,802,420 | A * | 9/1998 | Garr et al. | 399/27 |
| 5,909,609 | A * | 6/1999 | Yahata et al. | 399/262 X |
| 6,748,186 | B1 | 6/2004 | Skrainar et al. | |
| 7,009,719 | B2 | 3/2006 | Willis et al. | |
| 7,061,391 | B2 * | 6/2006 | Hopper et al. | 399/24 X |
| 7,263,661 | B2 * | 8/2007 | Chavers et al. | 399/81 X |
| 7,280,781 | B2 | 10/2007 | Willis | |
| 7,292,795 | B2 * | 11/2007 | Kuroki et al. | 399/33 |

* cited by examiner

*Primary Examiner*—Sandra L Brase
(74) *Attorney, Agent, or Firm*—Fay Sharpe LLP

(57) ABSTRACT

Document processing systems and methods are presented in which the remaining amount of toner, replenisher, or other print consumable in a multi-dispenser bottle consumable supply system is determined, and a user can configure a user interface to graphically display the remaining print consumable supply levels for one or more colors in one or more print engines.

18 Claims, 5 Drawing Sheets

DOCUMENT PROCESSING SYSTEM WITH CONFIGURABLE GRAPHIC DISPLAY OF PRINT CONSUMABLE LEVEL

BACKGROUND

The present exemplary embodiment relates to document processing systems such as printers, copiers, multi-function devices, etc., and more particularly to configurable graphical display of print consumable levels in document processing systems having one or more print or marking engines that are supplied with consumable materials such as toner, ink, replenisher, paper, etc. Conventionally, these systems include some form of warning system to alert the user when the consumable material supply is depleted. In many printers and copiers, the print engine must be stopped to refill the consumables, although some systems may allow toner or other consumable to be refilled without interrupting the operation of the print engine. Often, however, the user is only notified when the system can no longer function without replenishment of the consumable material, such as when the print engine is out of toner. Thus, replacement of toner cartridges, paper, and other print system consumable supplies generally contributes to system down-time, and improved techniques and systems are desirable to facilitate the timely provision of replenishable consumables to document processing systems while mitigating system down-time.

BRIEF DESCRIPTION

The present disclosure provides document processing systems and methods that may be employed to allow a user to easily view a graphical indication of the current status of consumable supplies at any time. The particular form of the graphical rendering, moreover, can be set by the user in certain embodiments. The various aspects of the disclosure thus facilitate the intelligent scheduling of consumable replenishment without having to wait for the system to run out of toner or other supplies.

In accordance with one or more exemplary aspects of the disclosure, a document processing system is provided that includes one or more print engines as well as a print consumable supply system that supplies toner, ink, paper, replenisher, or other print consumable from one or more print consumable dispensers to the print engine. The system further includes a controller operative to determine the amount of remaining print consumable and a user interface (UI) with a graphic display. The user interface may be integral with the printing system, or may be provided remotely, such as application software running on a computer networked to the printing system. The interface displays a graphical print consumable supply view on the graphic display that graphically indicates the remaining amount of the consumable(s). The system may support multi-color printing, with the supply system including consumables specific to a number of different source colors, such as cyan, magenta, yellow, and black toner, where the supply view in certain embodiments may provide individual graphical indications of remaining supply levels for each color. Where the supply system provides multiple dispensers for a given color, moreover, the view can be configured to indicate the remaining amount of the consumable in terms of remaining dispensers, including partially full dispensers by color.

In certain implementations, moreover, the graphical print consumable supply view is user-configurable, allowing selection from a number of different view styles for display on the user interface. Thus, for example, the user may be able to select a percentage view that graphically illustrates the percentage of consumable remaining for each of the plurality of colors, a bottle count view graphically illustrating the number of dispensers currently having remaining printing consumable by color, a number of pages view indicating a number of remaining pages that can be printed by color, and a time view indicating the amount of printing time remaining by color. In one implementation, moreover, the interface may allow the user to selectively view or hide the print consumable supply view.

Further aspects of the disclosure provide a method of indicating the amount of remaining printer consumable in a document processing system. The method includes determining the amount of remaining print consumable in one or more print consumable dispensers in a print consumable supply system that supplies print consumable to a print engine, and displaying a graphical print consumable supply view on a user interface of the system to graphically indicates the amount of remaining print consumable. The method may further include allowing a user to select from a plurality of display views for rendering on the user interface, as well as allowing the user to selectively view or hide the print consumable supply view.

BRIEF DESCRIPTION OF THE DRAWINGS

The present subject matter may take form in various components and arrangements of components, and in various steps and arrangements of steps. The drawings are only for purposes of illustrating preferred embodiments and are not to be construed as limiting the subject matter.

DETAILED DESCRIPTION

Figure 1:
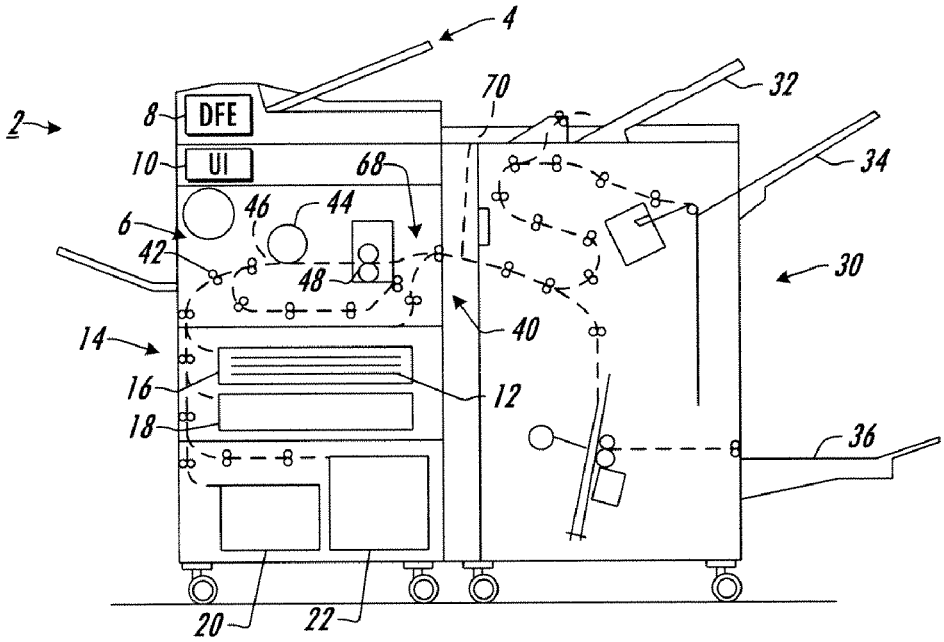
FIG. 1 is a schematic system level diagram illustrating an exemplary document processing system with a print engine and a user interface that provides user-configurable graphic display of toner consumable levels in accordance with one or more aspects of the present disclosure.

Referring now to the drawing figures, several embodiments or implementations of the present disclosure are hereinafter described in conjunction with the drawings, wherein like reference numerals are used to refer to like elements throughout, and wherein the various features, structures, and graphical renderings are not necessarily drawn to scale. The disclosure relates to automatic graphical presentation of print system consumable material supply levels via a user interface. The various aspects of the disclosure are hereinafter illustrated and described in the context of exemplary graphical user interface display screens which can be rendered to a user or operator at a user interface integral with a document processing (printing) system, and/or which can be provided as a display on a user's personal computer or other device operatively connected to the document processing system, such as by one or more wired and/or wireless networks, wherein any such implementations and variations thereof are contemplated as falling within the scope of the present disclosure. Moreover, while the various aspects of the disclosure are described in the context of providing user-friendly graphical indications of toner levels in multi-color printing systems, the various concepts and aspects of the disclosure are also applicable to other forms of printing system consumables, including without limitation toner, replenisher, ink, paper, etc., wherein the disclosure is not limited to the illustrated embodiments. As shown in the examples below, the disclosure presents a user interface (UI) dialogue via graphical display screens and visual indicia thereon that facilitates choice or selection by a user of a style of view for toner level display to accommodate visual monitoring of system toner levels for the user's specific work environment, for example, percentage of toner remaining per color, the number of bottles (toner dispensers) remaining per color, the number of pages that can be printed per color, and the number of hours/minutes of usage remaining per color.

Figure 2:
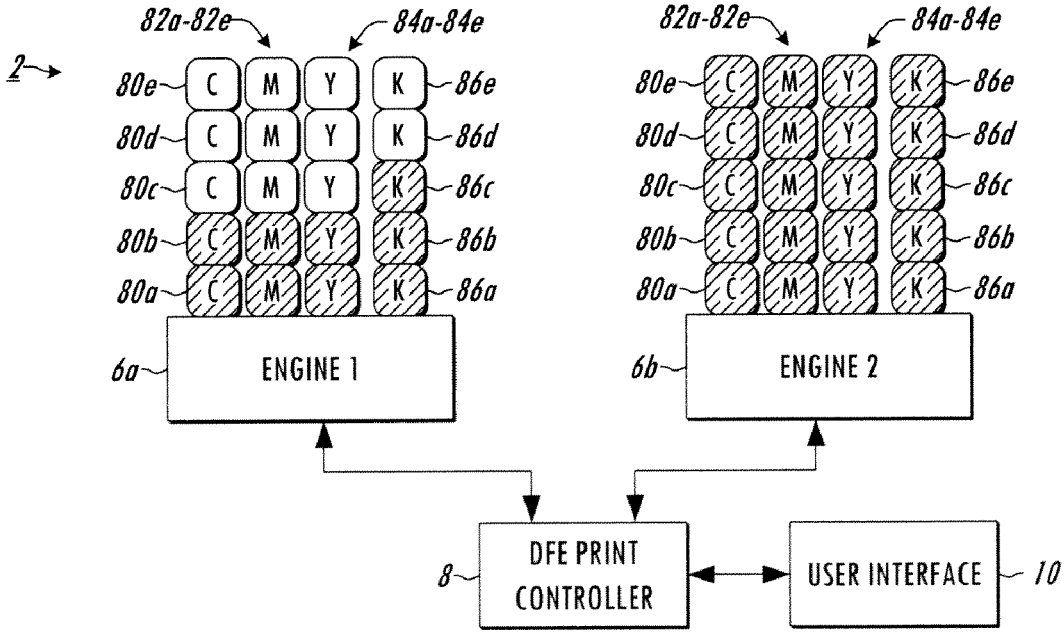
FIG. 2 is a simplified schematic diagram illustrating an exemplary dual-print engine implementation of the system of FIG. 1 with two similarly equipped print engines having dedicated toner consumable supply systems, each supply system including multiple dispensers for each color, and with a controller that provides toner levels to a graphical user interface in accordance with the present disclosure.
Figure 3:
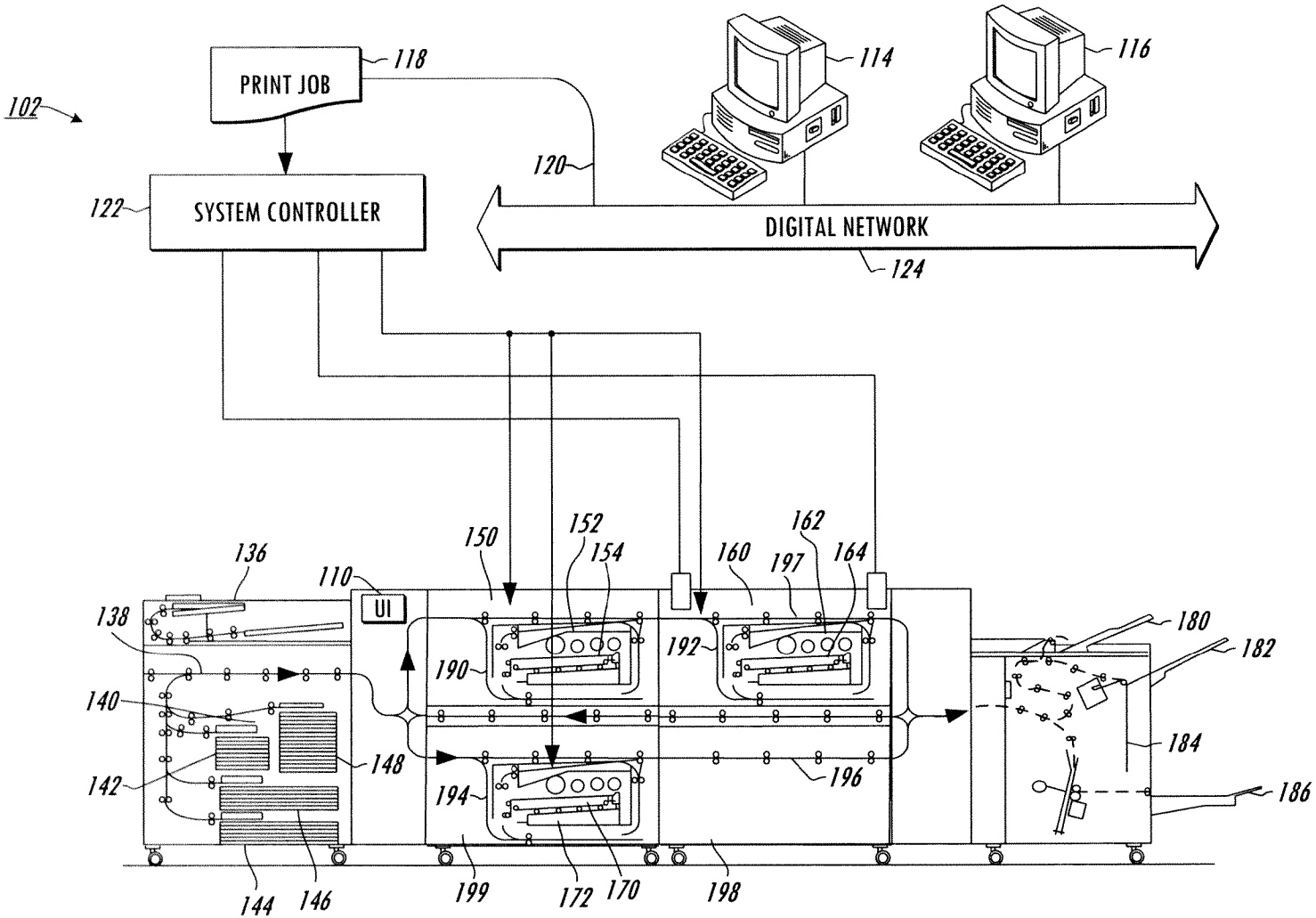
FIG. 3 is a schematic system level diagram illustrating another exemplary document processing system with multiple print engines in which the graphical display aspects of the present disclosure may be carried out.

FIGS. 1 and 2 illustrate one exemplary document processing or printing system 2 and a user interface 10 thereof in which one or more exemplary aspects of the disclosure may be implemented. FIG. 3 illustrates another exemplary document processing system 102 having multiple print engines in which the various aspects of the present disclosure may also be advantageously implemented. The system 2 of FIG. 1 can be any form of commercial printing apparatus, copier, printer, facsimile machine, or other system which may include a scanner or other input device 4 that scans an original document text and/or images to create an image comprising pixel values indicative of the colors and/or brightness of areas of the scanned original, or receives images such as in a print job, and which has a marking engine or print engine 6 by which visual images, graphics, text, etc. are printed on a page or other printable medium, including xerographic, electro photographic, and other types of printing technology, wherein such components are not specifically illustrated in FIG. 1 to avoid obscuring the various aspects of the present disclosure.

As shown in FIG. 1, the exemplary document processing system 2 includes a print engine 6, which may be any device or marking apparatus for applying an image from a digital front end (DFE) printer job controller 8 to printable media (print media) such as a physical sheet of paper, plastic, or other suitable physical media substrate for images, whether precut or web fed, where the input device 4, print engine 6, and controller 8 are interconnected by wired and/or wireless links for transfer of electronic data therebetween, including but not limited to telephone lines, computer cables, ISDN lines, etc. The printing system 2, moreover, includes an integral user interface 10 with a display and suitable operator/user controls such as buttons, touch screen, etc. The print engine 6 generally includes hardware and software elements employed in the creation of desired images by electrophotographic processes wherein suitable print engines 6 may also include ink-jet printers, such as solid ink printers, thermal head printers that are used in conjunction with heat sensitive paper, and other devices capable of printing or marking an image on a printable media.

The image input device 4 may include or be operatively coupled with conversion components for converting the image-bearing documents to image signals or pixels or such function may be assumed by the printing engine 6. In the illustrated document processor 2, the printer controller 8 provides the output pixel data from memory to a print engine 6 that is fed with a print media sheets 12 from a feeding source 14 such as a paper feeder which can have one or more print media sources or paper trays 16, 18, 20, 22, each storing sheets of the same or different types of print media 12 on which the marking engine 6 can print. The exemplary print engine 6 includes an imaging component 44 and an associated fuser 48, which may be of any suitable form or type, and may include further components which are omitted from the figure so as not to obscure the various aspects of the present disclosure. In one example, the print engine 6 may include a photoconductive insulating member or photoreceptor which is charged to a uniform potential via a corotron and exposed to a light image of an original document to be reproduced via an imaging laser under control of a controller of the DFE 8, where the exposure discharges the photoconductive insulating surface of the photoreceptor in exposed or background areas and creates an electrostatic latent image on the photoreceptor corresponding to image areas of the original document. The electrostatic latent image on the photoreceptor is made visible by developing the image with an imaging material such as a developing powder comprising toner particles via a development unit, and the customer image is then transferred to the print media 12 and permanently affixed thereto in the fusing process.

In a multicolor electrophotographic process, successive latent images corresponding to different colors can be formed on the photoreceptor and developed with a respective toner of a complementary color, with each color toner image being successively transferred to the paper sheet 12 in superimposed registration with the prior toner image to create a multilayered toner image on the printed media 12, and where the superimposed images may be fused contemporaneously, in a single fusing process. The fuser 48 receives the imaged print media from the image-forming component and fixes the toner image transferred to the surface of the print media 12, where the fuser 48 can be of any suitable type, and may include fusers which apply heat or both heat and pressure to an image. Printed media from the printing engine 6 is delivered to a finisher 30 including one or more finishing output destinations 32, 34, 36 such as trays, stackers, pans, etc.

The document processing system 2 is operative to perform these scanning and printing tasks in the execution of print jobs, which can include printing selected text, line graphics, images, machine ink character recognition (MICR) notation, etc., on either or both of the front and back sides or pages of one or more media sheets 12. An original document or image or print job or jobs can be supplied to the printing system 2 in various ways. In one example, the built-in optical scanner 4 may be used to scan an original document such as book pages, a stack of printed pages, or so forth, to create a digital image of the scanned document that is reproduced by printing operations performed by the printing system 2 via the print engine 6. Alternatively, the print jobs can be electronically delivered to the system controller 8 via a network or other means, for instance, whereby a network user can print a document from word processing software running on a network computer as illustrated and described in further detail with respect to FIG. 3 below, thereby generating an input print job.

A print media transporting system or network or highway 40 of the document processing system 2 links the print media source 14, the print engine 6, and the finisher 30 via a network of flexible automatically feeding and collecting drive members, such as pairs of rollers 42, spherical nips, air jets, or the like, along with various motors for the drive members, belts, guide rods, frames, etc. (not shown), which, in combination with the drive members, serve to convey the print media 12 along selected pathways at selected speeds. Print media 12 is thus delivered from the source 14 to the print engine 6 via a pathway 46 common to the input trays 16, 18, 20, 22, and is printed by the imaging component 44 and fused by the fuser 48, with a pathway 46 from the print engine 6 merging into a pathway 70 which conveys the printed media 12 to the finisher 30, where the pathways 46, 48, 70 of the network 40 may include inverters, reverters, interposers, bypass pathways, and the like as known in the art. In addition, the print engine 6 may be configured for duplex or simplex printing and a single sheet of paper 12 may be marked by two or more print engines 6 or may be marked a plurality of times by the same marking engine 6, for instance, using internal duplex pathways.

Referring also to FIG. 2, the exemplary document processing system 2 provides an advanced printer consumable dispensing apparatus assembly or supply system in which each color toner is provided via a plurality of toner bottles or dispensers, including Cyan (C), Magenta (M), Yellow (Y), and Black (K). As shown in FIG. 2, for example, the Cyan color is supplied via five Cyan toner dispensers 80*a*-80*e*, with each dispenser being adjacent to the previous dispenser 80. Similarly, five bottle dispensers 82*a*-82*e* are provided for Magenta toner, bottles 84*a*-84*e* supply Yellow toner, and bottles 86*a*-86*e* supply black toner to the print engine 6. Moreover, as depicted in FIG. 2, the document processing system 2 may include multiple print engines with associated multi-bottle toner supply systems, wherein the simplified illustration in FIG. 2 depicts a first such print engine 6*a* and a second engine 6*b*, each operatively coupled with the DFE controller 8. In this regard, the system 2 provides multiple dispensers 80, 82, 84, and 86 for each of four toner colors Cyan, Magenta, Yellow, and Black, respectively, for each of the print engines 6*a* and 6*b*. As further illustrated in FIG. 2, the print controller 8 is operatively coupled with the print engines 6*a*, 6*b*, the user interface 10, and the multi-bottle toner supply systems providing toner to the print engines 6*a*, 6*b* so as to provide user configurable graphical indications of the remaining toner supply for each of the print engines 6*a*, 6*b* in accordance with various aspects of the present disclosure.

In the exemplary toner supply systems of FIG. 2, the toner dispenser bottles are stacked so that the toner/replenisher will empty throughout the top bottle into the bottom bottle through the flow of gravity or some other mechanical means, with successive dispensers providing consumable to the next lower dispenser. The printing consumable inside each bottle 80, 82, 84, 86 can be toner, replenisher, etc., depending on the print engine needs and/or requirements. The user interface 10 is operatively coupled with the first print engine 6*a*, the second print engine 6*b*, and the DFE controller 8 that provides job print scheduling and other functionality. The controller 8 gathers information from one or more sensing mechanisms associated with each of the toner consumable supply systems. In one possible implementation, a sensing mechanism is provided for each set of printing consumable dispenser bottles, wherein the sensing mechanism preferably operates to discern the level of toner within partially empty dispensers, in order to provide an indication on the user interface 10 as to which bottles are full, which are empty, and which are partially full. In this regard, any suitable consumable level sensing technology may be employed within the scope of the present disclosure, including without limitation sensing based on opacity, infrared, weight measurement, pressure measurement, or any other known means. The controller 8 receives the signals from the toner level sensors and determines on a regular basis an amount of remaining print consumable for each color C, M, Y, and K. The controller 8 may further perform certain calculations to estimate remaining number of pages that can be printed using the remaining consumables, the remaining printing time that the system can operate using the remaining consumables, etc. The user interface 10 operates under control of the controller 8 according to the determined amounts of remaining toner consumable to render the remaining consumable levels to the user or operator. In particular, the interface 10 includes a graphic display and operates to display a graphical print consumable supply view on the graphic display that graphically indicates the amount of remaining print consumable, in this case, for each of multiple colors, where the display can be set to display the remaining toner level for either of the print engines 6*a* or 6*b*.

The exemplary user-configurable interface 10 and the graphical renderings provided by this disclosure facilitate the usage of the multi-bottle supply system in order to reduce or minimize the system down-time while allowing the user or operator to refill the bottles or otherwise replenish the toner consumable supply in the system 2. For instance, a user may advantageously implement a top-off strategy for each color that is not at its maximum. As depicted in FIG. 2, for example, the Cyan supply currently has two remaining full toner bottles, with the upper three bottles being currently empty for the first print engine 6*a*. In this example, the same is true of the Magenta and Yellow toner in the first engine, with the Black toner supply having three remaining full toner dispensers in the first engine 6*a* and with the dispensers of the second engine 6*b* all being full. The user may advantageously monitor this situation via a selected one of a plurality of graphical supply level views on the graphic display of the user interface 10 to facilitate implementation of a replenishment regimen for the system 2. Thus, at the point in time illustrated in FIG. 2, the user can see from the interface graphic display that toner is needed for the first engine 6*a*, whereas the second engine supplies are full.

Referring also to FIG. 3, an exemplary multi-print engine printing or document processing system 102 is shown with a graphical user interface 110 in accordance with the present disclosure. The system 102 in FIG. 3 includes a plurality of printing or marking systems 150, 160, and 199, each of which includes an associated marking or print engine 152, 162, 172 along with corresponding entry and exit inverter/bypasses 190, 192, and 194, respectively. The print engines 152, 162, 172, moreover, may be removable, for example, wherein the system in FIG. 3 illustrates a currently empty marking unit area 198 capable of being outfitted with a fourth print engine (not shown), and wherein one or more of the illustrated print engines 152, 162, 172 may optionally be removed from the system 110 (e.g., for repair, etc.), whereby the system 110 provides a modular approach to multiple-engine system architecture. The provision of multiple print engines enhances the system 110 with respect to features and capabilities as various marking tasks for a given print job 118 may advantageously be distributed among the print engines 152, 162, 172. In this regard, some or all of the print engines 152, 162, 172 may be identical or functionally equivalent in order to provide redundancy or improved productivity through parallel printing. Alternatively or in combination, some or all of the print engines may be different to provide different capabilities, for example, where the marking engines 162, 172 may be color marking engines, while the marking engine 152 may be a black (K) marking engine.

As further shown in FIG. 3, the system 102 includes a system controller 122 includes digital front end (DFE) functionality as in the example of FIG. 1 above, and is operatively coupled with the user interface 110 and the toner supply systems of each print engine 152, 162, 172 for graphically rendering a toner supply view on the interface 110 in accordance with the various aspects of the present disclosure. The controller 122, moreover, may implement image quality control functions to modify one or more target colors via actuators 154, 164, and 170. The illustrated print engines 152, 162, 172 employ xerographic printing technology wherein an electrostatic image is formed and coated with a toner material, and then transferred and fused to paper or another print medium by application of heat and pressure. Alternatively, print engines employing other printing technologies can be provided in the system 102, such as ink jet printing, thermal impact printing, etc.

The system 102 further includes a print media feeding source or feeder 140 with associated media conveying components 138, as well as a finisher 184 implementing various finishing functions such as collation, stapling, folding, stacking, hole-punching, binding, postage stamping, etc. The source 140 includes input trays 142, 144, 146, 148 connected with the print media conveying components 138 to provide selected types of print media to the print engine(s) 152, 162, and/or 172. Each of the print media sources 142, 144, 146, and/or 148 can store sheets of the same type of print media, or can store different types of print media. For example, the print media sources 144, 146 may store the same type of large-size paper sheets, print media source 142 may store company letterhead paper, and the print media source 148 may store letter-size paper. The print media can be substantially any type of media upon which one or more of the marking engines 152, 162, 172 can print, such as high quality bond paper, lower quality "copy" paper, overhead transparency sheets, high gloss paper, etc. The finisher 184 includes two or more print media finishing destinations or stackers 180, 182, 186 for collecting sequential pages of each print job that is being contemporaneously printed by the printing system 102 to accommodate multiple jobs arriving at the finisher 184 concurrently. Once processed, the finisher 184 deposits each sheet in one of the print media finishing destinations 180, 182, 186, which may be trays, pans, stackers and so forth. In addition, bypass routes in each print engine 152, 162, and 172 allow certain sheets to pass through the processing unit without interacting with the print engine. Also, branch paths are provided to take the sheet into the associated marking engine 152, 162, 172 and to deliver the sheet back to the upper or forward paper paths 196, 197 of the associated processing unit.

As further illustrated in FIG. 3, the document processing system 102 is operative to execute print jobs 118 delivered to the controller 122 from an external source, such as one or more computers 114, 116 connected to the system 102 via one or more networks 124 and associated cabling 120, or from wireless sources, or alternatively print jobs may be created by the system 102 based on documents scanned at an input scanner 136. The print job execution may include printing selected text, line graphics, images, machine ink character recognition (MICR) notation, etc., on the front and/or back sides or pages of one or more sheets of paper or other printable media. In this regard, some sheets may be left completely blank in accordance with a particular print job 118, and some sheets may have mixed color and black-and-white printing. Execution of the print job 118, moreover, may include collating the sheets in a certain order, along with specified folding, stapling, punching holes into, or otherwise physically manipulating or binding the sheets at the finisher 184. Print jobs 118 can also be provided to the controller 122 of the system 102 via an integral optical disk reader (not illustrated), and/or from a dedicated computer that is connected only to the printing system 102. In certain embodiments the system 102 may be a stand-alone printer or a cluster of networked or otherwise logically interconnected printers, with each printer having its own associated print media source and finishing components including a plurality of final media destinations, print consumable supply systems and graphical user interface. Moreover, the user interface 110 may be integral with the system 102 and/or may be implemented on one or more external devices, such as printer management application software running on one or more networked computers 114, 116, etc.

Figure 4:
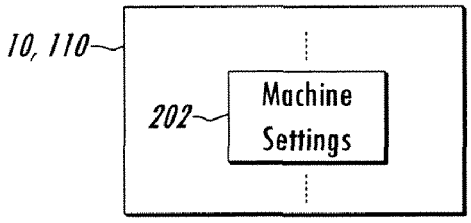
FIG. 4 is a partial view of the exemplary graphic display showing prompting for user configuration of machine settings in the systems of FIGS. 1 and 3.

Referring now to FIGS. 4-10, FIGS. 4 and 5 illustrate partial view of the exemplary graphical display of the user interfaces 10, 110 in the systems 2 and 102 of FIGS. 1 and 3, respectively. FIG. 4 shows exemplary prompting for user configuration of machine settings as part of a menu-driven graphical print system screen flow. In the illustrated embodiment, the user or operator is presented with a selectable "Machine Settings" indicia 202. The indicia 202 and other illustrated indicia in the illustrated embodiments preferable comprise a user-selectable "button" type indicia which the user can select using a keyboard, mouse, vocal command responsive system, etc., and/or the interface 10, 110 may be a touch-screen type interface allowing the user to touch the screen location of the indicia 202 to set one or more machine settings for the system 2, 102. In other embodiments, one or more buttons or other navigation features may be provided as part of the user interface 10, 110.

Figure 5:
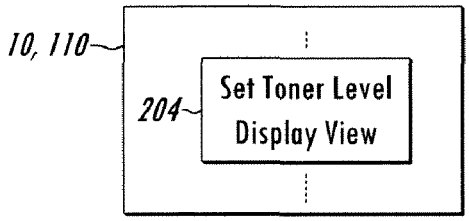
FIG. 5 is another partial view of the exemplary graphic display showing prompting for user selection of toner consumable level display views in the systems of FIGS. 1-3.
Figure 6:
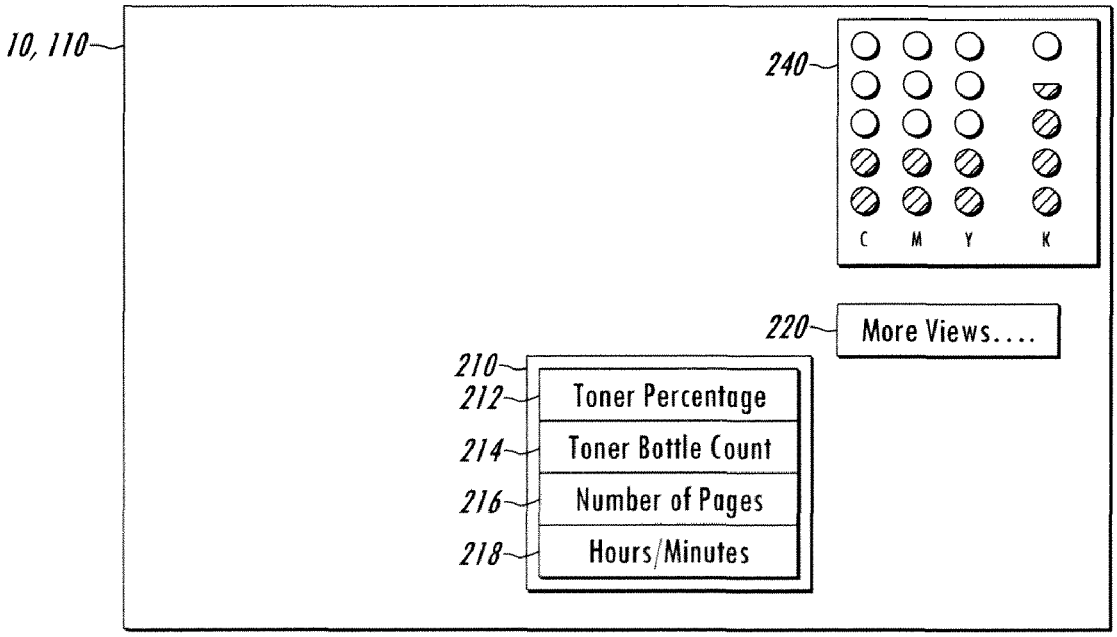
FIG. 6 is a full screen view of the graphic display in the systems of FIGS. 1-3, showing an exemplary toner bottle count view along with prompting for user selection of different consumable supply level views in accordance with the disclosure.

Upon selecting "Machine Settings" indicia 202 in FIG. 4, the user interface 10, 110 presents the user with one or more options including a "Set Toner Level Display View" indicia 204 as shown in FIG. 5 for user selection of toner consumable level display views as further illustrated in FIGS. 6-10 below. When the user selects this indicia 204 of FIG. 5, the exemplary user interface 10, 110 presents (FIG. 6) a graphical listing 210 of possible toner level displays from which the user can select the desired rendering of toner supply level in the system 2, 102. In the example of FIG. 6, the user interface 10, 110 prompts the user for selection among four exemplary toner level graphical display views, where the listing 210 presents selectable "button" type indicia 212, 214, 216, and 218 for "Toner Percentage", "Toner Bottle Count", "Number of Pages", and "Hours/Minutes" views, respectively. In addition, the user interface 10, 110 in FIG. 6 presents the user with the possibility of selecting other views via a selectable indicia 220, and further renders the currently selected toner level display view in the upper right-hand corner of the graphic display, in this case a Toner Bottle Count view 240 as illustrated and described further below with respect to FIG. 8. The user can select any of the indicia 212-218 in FIG. 6, by which the current display view is changed to the selected view for graphically indicating the current toner supply level(s) to the user via the user interface 10, 110. In certain embodiments, moreover, the user may be prompted to selectively view or hide the print consumable supply view.

Figure 7:
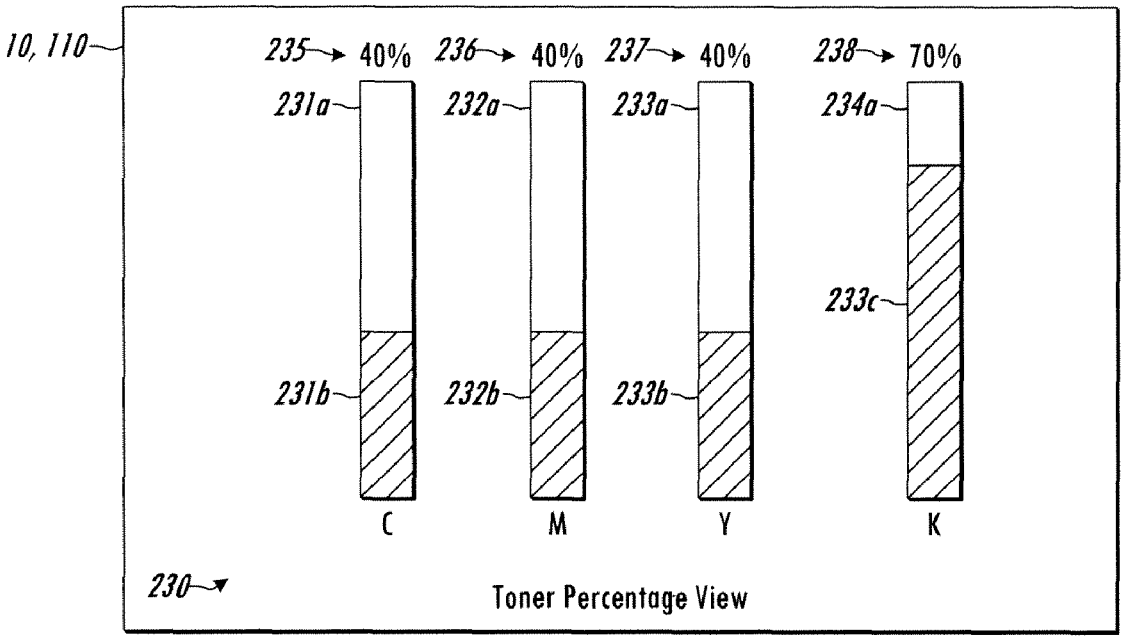
FIG. 7 is another view of the graphic display in the systems of FIGS. 1-3, showing an exemplary toner percentage view that graphically illustrates the percentage of toner remaining for each color.

FIG. 7 illustrates the graphical display of the user interface 10, 110 on which an exemplary toner percentage view 230 is rendered that graphically illustrates the percentage of toner remaining for each color C, M, Y, and K in the systems 2, 102. In this example, the user has selected to graphically view the percentage of remaining toner by color, for instance, by selecting the indicia 212 in FIG. 6 above. As shown in FIG. 7, the exemplary toner percentage view 230 includes vertical bar graph type indicia 231-234 including open portions 231*a*, 232*a*, 233*a*, and 234*a* and colored or shaded portions 231*b*, 232*b*, 233*b*, and 234*b*, respectively. The colored or shaded portions 231*b*-234*b* are indicative of the amount of remaining toner of the corresponding color C, M, Y, or K as a percentage of the total toner capacity for that color, and the non-shaded or open portions 231*a*-234*a* represent empty bottles or portions thereof in the systems 2, 102. In certain embodiments, if the graphic display is color capable, the shaded or colored portions 231*b*-234*b* may advantageously be colored with the corresponding Cyan, Magenta, Yellow, and Black colors, respectively, thereby aiding the user in determining which colors need replenishment. The illustrated view 230, moreover, includes numeric indicia 235-238 for the colors C, M, Y, and K showing numeric percentage values representing the amount of remaining toner relative to the total capacity per color. Thus, in the example situation shown in FIG. 2 above, the first print engine 6*a* in the system 2, 102 has 40% remaining Cyan, Magenta, and Yellow toner, as well as 70% remaining black toner.

Figure 8:
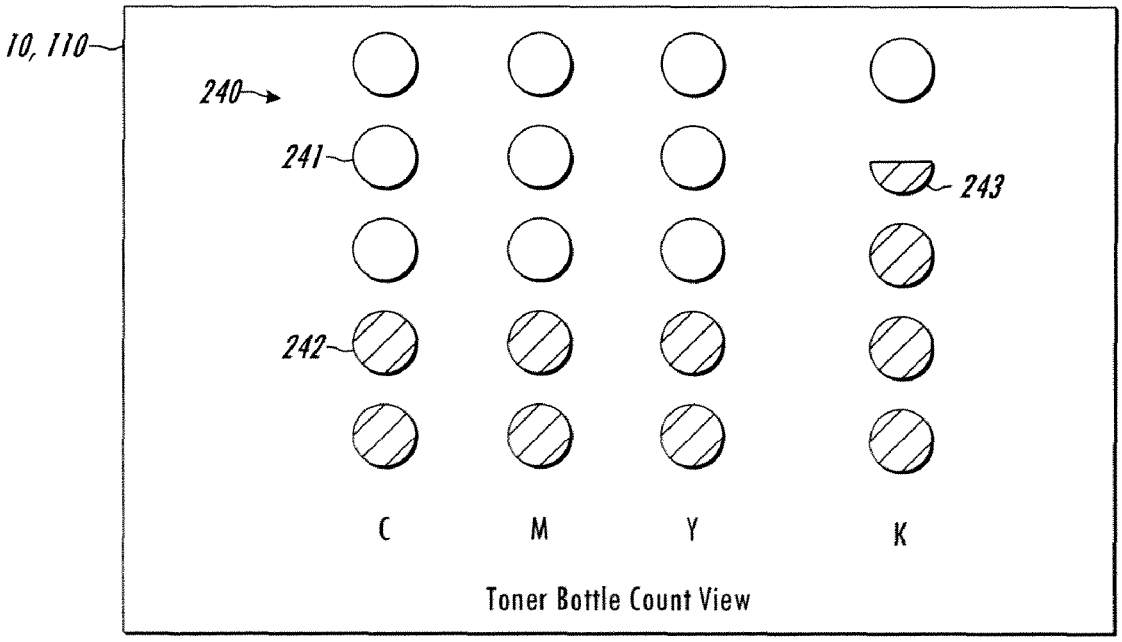
FIG. 8 is another view of the graphic display in the systems of FIGS. 1-3, showing an exemplary bottle count view that graphically illustrates the number of toner dispensers that have remaining toner for each color.

FIG. 8 illustrates another view of the exemplary graphical display in the systems 2, 102 of FIGS. 1 and 3, showing an exemplary bottle count view 240 that graphically illustrates the number of toner dispensers 80, 82, 84, and 86 that have remaining toner for each color C, M, Y, and K, respectively. The view 240 includes circular open or unshaded indicia 241 and full and partial shaded or colored indicia 242 and 243, respectively. Like the above percentage view 230 in FIG. 7, the bottle view 240 of FIG. 8 may advantageously provide for color coding of the indicia 242 and 243 (e.g., if the graphic display is a color display), with the shaded or colored portions 242 and 243 be in colored Cyan, Magenta, Yellow, and Black corresponding to the color of toner they represent. As noted in FIG. 8, moreover, the view 240 provides for indicia 243 of partially full toner dispenser bottles, which may indicate half-full, quarter-full, or other fractionally full levels for a particular sensing capability of the supply system. In the example of FIG. 8, moreover, the Cyan, Magenta, and Yellow toner supplies for the first print engine 6*a* are each at 40% capacity, where the five-bottle per color implementation of FIG. 2 corresponds to two full bottles and three empty bottles for each of these colors in the bottle view 240 of FIG. 8, whereas the 70% full condition for Black toner corresponds to three completely full bottles, one half-filled bottle, and one empty bottle as shown in the "K" column of the bottle count view 240. In this regard, the bottle view 240 generally will include the same number of total indicia for a given color as there are bottle dispensers in the corresponding consumable supply system, and the granularity of the sensor capabilities in the toner supply system and the corresponding rendering of partially filled bottles (e.g., indicia 243) may be correlated in the bottle view 240, although not a strict requirement of the present disclosure.

Figure 9:
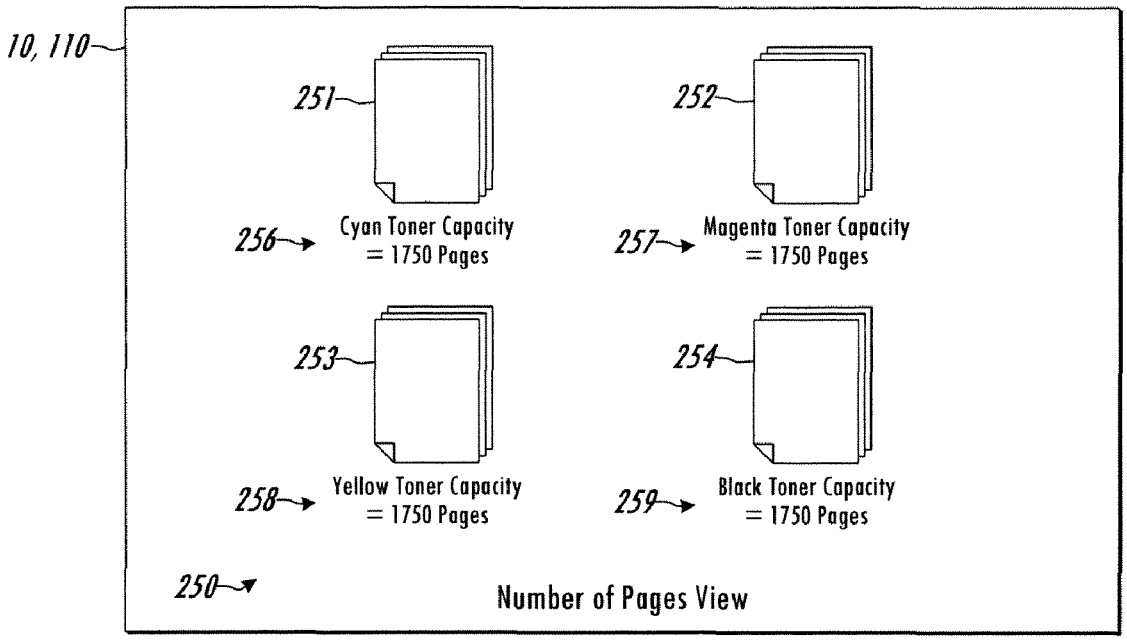
FIG. 9 is another view of the graphic display in the systems of FIGS. 1-3, showing an exemplary number of pages view indicating a number of remaining pages that can be printed for each color.

FIG. 9 shows the interface 10, 110 rendering an exemplary graphical number of pages view 250 indicating the number of remaining pages that can be printed for each color in the system 2, 102. In this view 250, page icons 251, 252, 253, and 254 are displayed for each of the colors C, M, Y, and K, respectively, where the icons 251-254 may be rendered in the corresponding Cyan, Magenta, Yellow, and Black colors if the graphic display of the user interface 10, 110 permits, although not a strict requirement of the disclosure. The view 250 also provides corresponding numeric toner capacity values 256, 257, 258, and 259 in terms of the number of pages that the system can print using the remaining toner for the Cyan, Magenta, Yellow, and Black colors, respectively. The controller 8, 122 in this regard computes the number of remaining pages for each color using stored or obtained information regarding the number of pages per unit of toner for the system 2, 102, based on the remaining toner supply levels sensed in the toner supply system.

Figure 10:
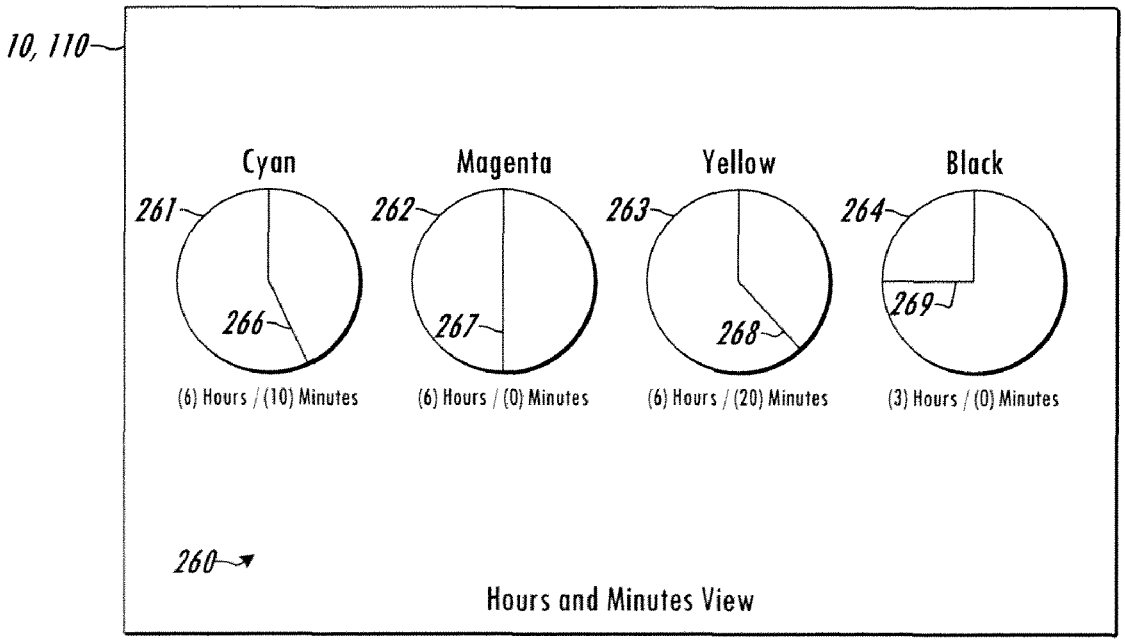
FIG. 10 is another view of the graphic display in the systems of FIGS. 1-3, showing an exemplary time view indicating the amount of printing time remaining for each color.

FIG. 10 illustrates another view of the exemplary graphic display in the systems 2, 102, in which a time view (e.g., hours and minutes) is presented graphically indicating the amount of printing time remaining for each color. The graphical view 260 includes circular clock-face type indicia 261, 262, 263, and 264 for the colors C, M, Y, and K, respectively, each of which having a corresponding position indicator 266, 267, 268, and 269 showing the amount of time remaining during which printing can continue for printed pages using the corresponding color. The controller 8, 122 in this example computes the remaining time in hours and minutes for each color using stored or obtained information regarding the temporal usage rates for each toner color for the system 2, 102, based on the remaining toner supply levels sensed in the toner supply system.

The above examples are merely illustrative of several possible embodiments of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been disclosed with respect to only one of several embodiments, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising". It will be appreciated that various of the above-disclosed and other features and functions, or alternatives thereof, may be desirably combined into many other different systems or applications, and further that various presently unforeseen or unanticipated alternatives, modifications, variations or improvements therein may be subsequently made by those skilled in the art which are also intended to be encompassed by the following claims.

The invention claimed is:

1. A document processing system, comprising:

a print engine operative to print images on a printable media, wherein the print engine uses print consumable of a plurality of colors;

a print consumable supply system operative to supply print consumable from one or more print consumable dispensers to the print engine, wherein the print consumable supply system includes a plurality of dispensers to supply print consumable associated with each of at least two of the plurality of colors;

a controller operatively coupled with the print engine and the print consumable supply system to receive signals from a plurality of toner level sensors and being operative to determine on a regular basis an amount of remaining print consumable in the plurality of dispensers for at least two of the plurality of colors based at least in part on the received signals; and a user interface comprising a graphic display, wherein the user interface displays the graphical print consumable supply view on the graphic display to graphically indicate at least three distinct levels of remaining print consumable in the plurality of the dispensers of the print consumable supply system for at least two of the plurality of colors.

2. The document processing system of claim 1:

wherein the print engine uses print consumable of a first color;

wherein the print consumable supply system includes a plurality of dispensers to supply print consumable associated with the first color, the plurality of dispensers comprising:

a first dispenser to provide print consumable associated with the first color to the print engine, and a second dispenser adjacent to the first dispenser, the second dispenser storing printing consumable associated with the first color and to provide print consumable associated with the first color to the first dispenser as the first dispenser provides print consumable to the print engine; and wherein the user interface displays the graphical print consumable supply view on the graphic display to graphically indicate the amount of remaining print consumable in the first and second dispensers.

3. The document processing system of claim 1, wherein the printing consumable is toner.

4. The document processing system of claim 1, wherein the graphical print consumable supply view is user-configurable.

5. The document processing system of claim 4, wherein the graphical print consumable supply view includes one of a toner percentage view graphically illustrating the percentage of toner remaining for each of the plurality of colors, a bottle count view graphically illustrating the number of dispensers currently having remaining printing consumable for the at least two of the plurality of colors, a number of pages view indicating a number of remaining pages that can be printed for each of the plurality of colors, and a time view indicating the amount of printing time remaining for each of the plurality of colors.

6. The document processing system of claim 4, wherein the graphical print consumable supply view includes a toner percentage view graphically illustrating the percentage of toner remaining for each of one or more colors.

7. The document processing system of claim 4, wherein the graphical print consumable supply view includes a bottle count view graphically illustrating the number of dispensers of the print consumable supply system currently having remaining printing consumable.

8. The document processing system of claim 7, wherein the bottle count view graphically illustrates partially full dispensers.

9. The document processing system of claim 4, wherein the graphical print consumable supply view includes a number of pages view indicating a number of remaining pages that can be printed.

10. The document processing system of claim 4, wherein the graphical print consumable supply view includes a time view indicating the amount of printing time remaining.

11. The document processing system of claim 1, wherein the printing consumable is toner.

12. The document processing system of claim 1, wherein the printing consumable is replenisher.

13. The document processing system of claim 1, wherein the user interface is integral with the system.

14. A method of indicating the amount of remaining printer consumable in a document processing system, the method comprising:

automatically determining on a regular basis an amount of remaining print consumable in one or more print consumable dispensers in a print consumable supply system that supplies print consumable to a print engine of the system based at least in part on signals received from a plurality of toner level sensors, wherein the print engine uses print consumable of a plurality of colors, and wherein the print consumable supply system includes a plurality of dispensers to supply print consumable associated with each of at least two of the plurality of colors; and displaying a graphical print consumable supply view on a user interface of the system to graphically indicates at least three distinct levels of the amount of remaining print consumable in each of at least two of the plurality of the dispensers of the print consumable supply system for at least two of the plurality of colors.

15. The method of claim 14, further comprising allowing a user to select from a plurality of display views for display on the user interface.

16. The method of claim 14, wherein the plurality of display views include a toner percentage view graphically illustrating the percentage of toner remaining for each of the plurality of colors, a bottle count view graphically illustrating the number of dispensers currently having remaining printing consumable for the at least two of the plurality of colors, a number of pages view indicating a number of remaining pages that can be printed for each of the plurality of colors, and a time view indicating the amount of printing time remaining for each of the plurality of colors.

17. The method of claim 14, further comprising allowing the user to selectively view or hide the print consumable supply view.

18. The method of claim 14, further comprising allowing the user to configure the graphical print consumable supply view.

* * * * *